US005669033A

United States Patent [19]

Takata et al.

[11] Patent Number: 5,669,033

[45] Date of Patent: Sep. 16, 1997

[54] DRIVE FORCE TRANSMITTING MECHANISM

[75] Inventors: Kenji Takata; Hiroshi Nakahashi, both of Kanagawa, Japan

[73] Assignee: Fuji Photo Film Co., Ltd., Kanagawa, Japan

[21] Appl. No.: 602,342

[22] Filed: Feb. 16, 1996

[30] Foreign Application Priority Data

Mar. 22, 1995 [JP] Japan ..... 7-062739

[51] Int. Cl.[6] ..... G03D 3/08

[52] U.S. Cl. ..... 396/612; 74/724; 74/425

[58] Field of Search ..... 396/617, 622, 396/612; 74/724, 329, 405, 425, 410

[56] References Cited

U.S. PATENT DOCUMENTS

| | | | |
|---|---|---|---|
| 3,805,633 | 4/1974 | Bacher et al. | 74/410 |
| 4,324,454 | 4/1982 | Kumai | 359/873 |
| 4,712,599 | 12/1987 | Komaki | 160/133 |

FOREIGN PATENT DOCUMENTS 2406408 6/1979 France .

*Primary Examiner*—D. Rutledge

*Attorney, Agent, or Firm*—Sughrue, Mion, Zinn, Macpeak & Seas

[57] ABSTRACT

When drawbacks which prevent driving of a portion to be driven arise, an excessive load is not applied to components in a drive system so that damage of the components can be prevented. Thrust force, i.e., force in the direction along an axis of rotation (in the direction of arrow B) is applied to a movable worm gear due to the excessive load. When the thrust force becomes larger than urging force of a compression coil spring, the movable worm gear moves axially in the direction of arrow B against the urging force of the compression coil spring. A pin is disengaged from a groove by the axial movement of the worm gear so that the torque of the rotating shaft is not transmitted to the worm gear. As a result, the drive force is not transmitted to the drive system of the downstream side of the movable worm gear. Accordingly, damage such as breakage of teeth of gears due to the excessive load applied to each gear can be prevented.

20 Claims, 3 Drawing Sheets

DRIVE FORCE TRANSMITTING MECHANISM

BACKGROUND OF THE INVENTION

1. Field of the Invention

The present invention relates to a drive force transmitting mechanism in which rotational drive force by a rotating shaft member is transmitted to a portion to be driven through a worm gear, more particularly, to a drive force transmitting mechanism in which, for example, drive force necessary for rotating a roller for conveying a photosensitive material in an automatic photosensitive material processing apparatus is transmitted from a drive source.

2. Description of the Related Art

In mechanical drive force transmitting devices, the drive force from a drive source (motor) is often transmitted to a portion to be driven via a gear. As a gear, a spur gear, a helical gear, a worm gear and the like suitable for a mechanical device are properly selected.

A mechanical drive force transmitting device is used, for example, in an automatic processing apparatus for a photosensitive material. In the automatic processing apparatus, an exposed photosensitive material is guided and conveyed by a plurality of rollers in a plurality of processing tanks in which processing solutions are stored in sequence to be processed. These rollers are generally driven by the following manner. A drive shaft driven by a drive source (motor) is disposed in the horizontal direction along a plurality of processing tanks above the processing tanks. A first worm gear adjacent to each of the processing tanks is secured on the drive shaft and the rotation of the drive shaft is transmitted to a shaft vertically disposed in each processing tank through a spur gear meshed with the worm gear. A spur gear is attached to one end of each of the rollers for guiding the photosensitive material and mesh together. One of the spur gears meshes with a second worm gear secured on one end of the vertical shaft. The vertical shaft is rotated so that the drive force is transmitted to the rollers through the second worm gear.

According to the above-described structure, the rollers are rotated through the vertical shaft when the drive shaft is rotated so that the photosensitive material is nipped by the rollers and conveyed along substantially U-shaped conveying paths in the processing tanks.

In the event that drawbacks in transportation, so-called jamming or the like of the photosensitive material are caused, each gear may be damaged due to an excessive load applied to the gear. In a conventional manner, to prevent such damage, when thrust force is applied to the first worm gear, a processing rack supporting a plurality of rollers, a group of spur gears and the shaft, disposed in a processing tank is lifted, so that the mesh of the first worm gear with the spur gear is released and breakage of each gear can be prevented.

However, in the case that the processing rack cannot be lifted, for example, when the processing tank is closely covered by a lid for preventing oxidation of developing solution, just above the processing rack, or when gears or other members fixed to the main body of the automatic processing apparatus are present in the direction of the thrust force acting on the worm gear so that the lifting of the processing rack is prevented, the countermeasures for preventing damage such as the above-described gear tooth breakage and the like cannot be used.

Further, in recent years, the size of automatic processing apparatuses is required to be smaller and a design for securing a space for moving a rack when jamming occurs cannot be adopted.

SUMMARY OF THE INVENTION

In view of the above-described facts, the present invention is to provide a drive force transmitting mechanism which can prevent damage of parts in a drive system without giving an excessive load applied to the parts when drawbacks which prevent the drive of a portion to be driven occur.

According to a first aspect of the present invention, there is provided a drive force transmitting mechanism which includes a first rotating shaft member which is rotated by receiving the drive force from a drive source, a first worm gear having a through hole through which said first rotating shaft member passes so that said first worm gear is rotated with said first rotating shaft member serving as a central axis of rotation of said first worm gear, a rotatable mechanism which is driven the rotation of said first worm gear, an urging one direction along said central axis of rotation, and means for engaging said first worm gear with said first rotating shaft member so as to be integrally rotated due to the urging of said urging means in the one direction, and for allowing said first worm gear to move relative to said first rotating shaft member in the other direction against the urging force by said urging means, to release the engagement of said first worm gear with said first rotating shaft member, such that said first worm gear and said first rotating shaft member rotate relative to each other by a thrust force acting on said first worm gear when the rotation of said rotatable mechanism is prevented.

According to a second aspect of the present invention, there is provided a drive force transmitting mechanism which includes a first rotating shaft member which has an axis of rotation substantially in the horizontal direction and is rotated by receiving the drive force from a drive source, a first worm gear having a through hole through which said first rotating shaft member passes so that said first worm gear is rotated with said first rotating shaft member serving as a central axis of rotation of said first worm gear, a first rotatable mechanism, which has an axis of rotation substantially in the vertical direction and which is rotated by the rotation of said first worm gear, a second rotatable mechanism which has an axis of rotation substantially in the horizontal direction and which is rotated by the rotation of said first rotatable mechanism, an urging means for urging said first worm gear so as to be movable to one direction relative to said first rotating shaft member along said central axis of rotation, and means for engaging said first worm gear with said first rotating shaft member so as to be integrally rotated due to the urging of said urging means in the one direction, and for allowing said first worm gear to move relative to said first rotating shaft member in the other direction against the urging force by said urging means, to release the engagement of said first worm gear with said first rotating shaft member, such that said first worm gear and said first rotating shaft member rotate relative to each other by thrust force acting on said first worm gear when the rotation of at least one of said first rotatable mechanism and said second rotatable mechanism is prevented.

According to a third aspect of the present invention, there is provided a drive force transmitting mechanism which includes a first rotating shaft member which has an axis of rotation substantially in the horizontal direction and is rotated by receiving the drive force from a drive source, a first worm gear having a through hole through which said first rotating shaft member passes so that said first worm gear is rotated with said first rotating shaft member serving as a central axis of rotation of said first worm gear, a rotatable mechanism, which has an axis of rotation substantially in the vertical direction and which is rotated by the rotation of said first worm gear, at least one roller which has an axis of rotation substantially in the horizontal direction and which is rotated by the rotation of said rotatable mechanism, and which guides and transports a photosensitive material in a processing tank, and an urging means for urging said first worm gear so as to be movable to one direction relative to said first rotating shaft member along said central axis of rotation, and means for engaging said first worm gear with said first rotating shaft member so as to be integrally rotated due to the urging of said urging means in the one direction, and for allowing said first worm gear to move relative to said first rotating shaft member in the other direction against the urging force by said urging means, to release the engagement of said first worm gear with said first rotating shaft member, such that said first worm gear and said first rotating shaft member rotate relative to each other by a thrust force acting on said first worm gear when the rotation of at least one of said rotatable mechanism and said roller is prevented.

According to the present invention, the portion or rotatable mechanism to be driven includes, for example, drive rollers for guiding and conveying a photosensitive material in processing solution tanks, by receiving the drive force from said worm gear via a gear.

According to the present invention, a first worm gear engages with a first rotating shaft member in a normal state, by urging force of an urging means. When the drive of a portion to be driven is prevented, the thrust force is applied to the first worm gear so that the first worm gear is moved (relative movement to the rotating shaft member) along the central axis of rotation of the first worm gear against the urging force by the urging means. Accordingly, the first rotating shaft member is rotated relative to the first worm gear and the rotational drive force of the first rotating shaft member is not transmitted to the downstream portions of the first worm gear. Therefore, damage of each parts of the drive system, in particular, breakage of the teeth of gears and the like due to the excessive load can be prevented.

Furthermore, an engaging means is constituted, for example, in such a manner that a pin (projection portion) is provided on the outer periphery of the first rotating shaft member in the radial direction thereof and a groove having substantially a U-shaped cross-section capable of accommodating the pin therein is provided at a part of one edge of the first worm gear in the direction of the central axis of rotation of the first worm gear. The pin is accommodated in the groove by the urging force of the urging means in a normal state so that the rotation of the first rotating shaft member is transmitted to the first worm gear via the pin. In contrast, when the first rotating shaft member and the first worm gear are moved in the other direction relative to one another against the urging force of the urging means, the pin is disengaged from the groove. Accordingly, the rotation of the first rotating shaft member is not transmitted to the first worm gear so that the first rotating shaft member runs idle. Further, for example, a ring-shaped groove may be formed on the outer periphery of the first rotating shaft member and a part of the ring-shaped groove is largely cut out in the direction of the central axis of rotation to form a groove having substantially a U-shaped cross-section. A pin (projection portion) projecting toward the direction of the center of rotating shaft is formed on the inner periphery of the first worm gear so as to correspond to the ring-shaped groove. The pin is accommodated in the U-shaped groove in a normal state so that effects similar to those of the above-described example can be obtained.

A portion to be driven according to the present invention includes, for example, rollers which are disposed in the processing tanks of the automatic processing apparatus and the like for guiding and transporting a photosensitive material. In particular, when the photosensitive material is conveyed in a processing rack, the drive of the portion to be driven may be prevented due to drawbacks in transportation such as jamming of the photosensitive material. The size of automatic processing apparatuses tends to be smaller and parts to be incorporated are assembled without an extra space. In the case that gears and the like used in the portion to be driven are broken due to the above-described jamming, replacement of such broken gears requires often much labor. Accordingly, to allow the rotating shaft member at the drive source side to run idle with regard to the worm gear when driving of the portion to be driven is prevented, is very effective measures for avoiding breakage and the like of the portion to be driven and labor efficiency for an automatic processing apparatus can be improved.

DESCRIPTION OF THE PREFERRED EMBODIMENTS

Figure 1:
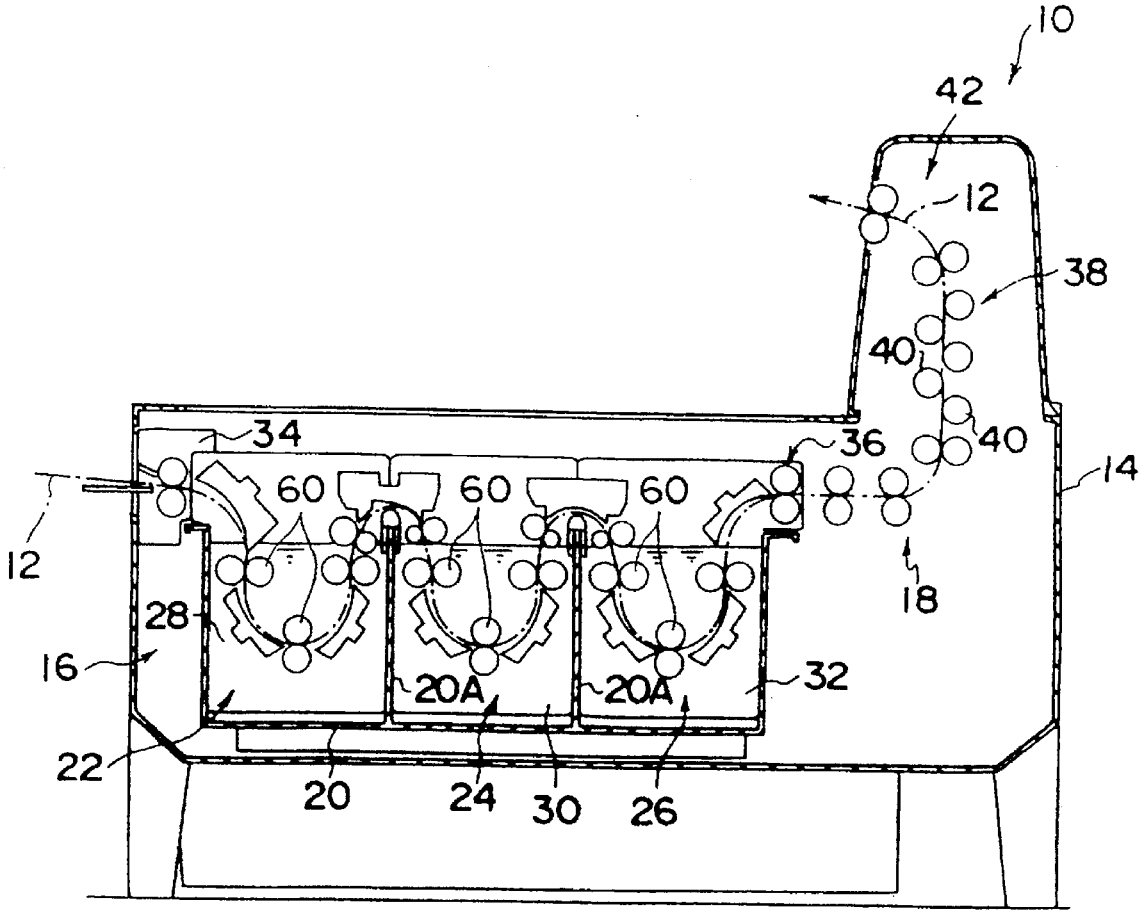
FIG. 1 is a schematic drawing of an automatic processing apparatus to which a drive force transmitting mechanism according to the present invention is applicable.

A processing station 16 and a drying station 18 are provided in a casing 14 of an automatic processing apparatus 10 in which a sheet film 12 on which an image has been printed is develop-processed.

A processing tank 20 in the processing station 16 is separated, by a plurality of separating walls 20A, into a developing tank 22 in which developing solution is stored, a fixing tank 24 in which fixing solution is stored and a washing tank 26 in which washing water is stored. Processing racks 28, 30 and 32 in which conveying paths are formed by a plurality of roller pairs and guides in the developing tank 22, the fixing tank 24 and the washing tank 26, are arranged, respectively. Insertion roller pairs 34 are provided at the upstream side of the developing tank 22, and a squeeze station 36 for squeezing water from the surface of the sheet film 12 is provided in the processing rack 32 in the washing tank 26.

The sheet film 12 drawn by the insertion roller pairs 34 into the processing station 16 is immersed in and processed with each of processing solutions of the developing solution, fixing solution and washing water in sequence. Thereafter, the sheet film 12 is conveyed out to a drying station 18 while water adhered on the surface of the sheet film 12 is being removed by squeezing in the squeezing station 36.

A conveying path for conveying the sheet film 12 upwardly is formed by arranging a group of rollers 38 in which a plurality of rollers including heat rollers 40 are arranged in a zigzag manner in the drying station 18. In the drying station 18, the sheet film 12 is dried by blowing drying air generated by a drying air generating means which is not illustrated onto the sheet film 12 while the sheet film 12 is being conveyed. The dried sheet film 12 is discharged from a turn station 42 to the upper side of the processing solution processing station 16.

An film accommodation station (not shown) in which a film insertion tray (not shown) and a film discharge tray (not shown) are superposed in two layers above the processing station 16 of the casing 14 and the sheet films 12 discharged from the drying station 18 are placed and stacked in the film discharge tray (not shown) of the upper tray.

Figure 2:
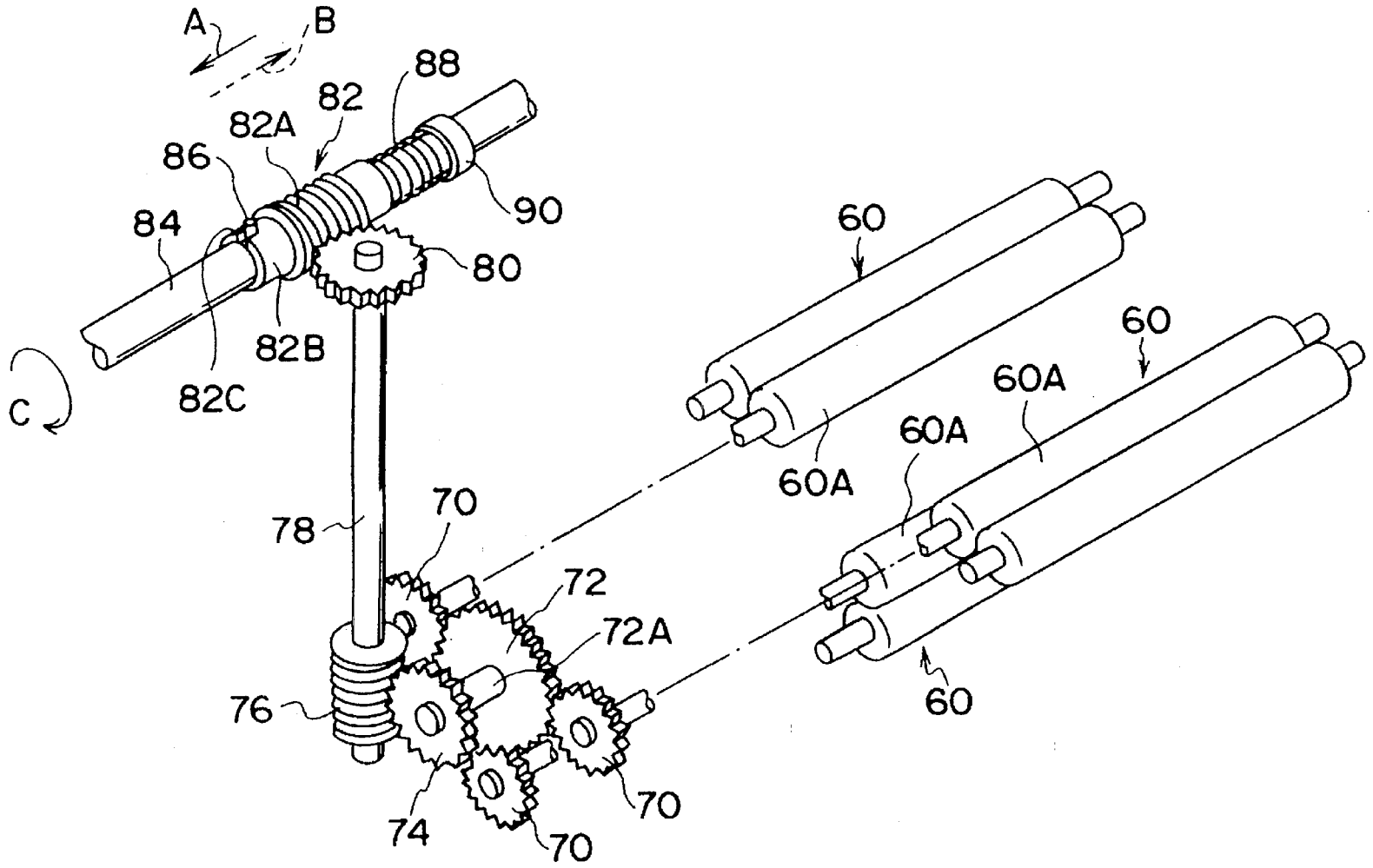
FIG. 2 is a schematic perspective view of a drive system in a processing rack of an automatic processing apparatus to which a drive force transmitting mechanism according to the present invention is applied.

FIG. 2 shows a schematic view of the drive system for transmitting the drive force to a plurality of roller pairs 60 provided in the processing rack 22 (24, 26).

A spur gear 70 is secured to one end of the rotating shaft of each inside roller 60 A of the roller pairs 60 for guiding and conveying the sheet film 12. The three spur gears 70 mesh with a large diameter spur gear 72 arranged at the center of the triangle formed by the spur gears 70. Accordingly, each spur gear 70 is rotated by the rotation of the large diameter spur gear 72 so that torque is imparted to the rollers 60A.

A spur gear 74 having a smaller diameter than that of the large diameter spur gear 72 is attached to the rotating shaft 72A of the large diameter spur gear 72. The spur gear 74 meshes with a worm gear 76. The worm gear 76 is secured to the bottom end of the shaft 78 which is vertically disposed. Drive force is transmitted from the shaft 78 extending to the outside of the processing tank in the vertical direction to the rotating shaft 72A by meshing the worm gear 76 with the spur gear 74.

A spur gear 80 is secured to the top end of the shaft 78. The spur gear 80 meshes with the movable worm gear 82 which is a main constituting component of the present invention.

Figure 3:
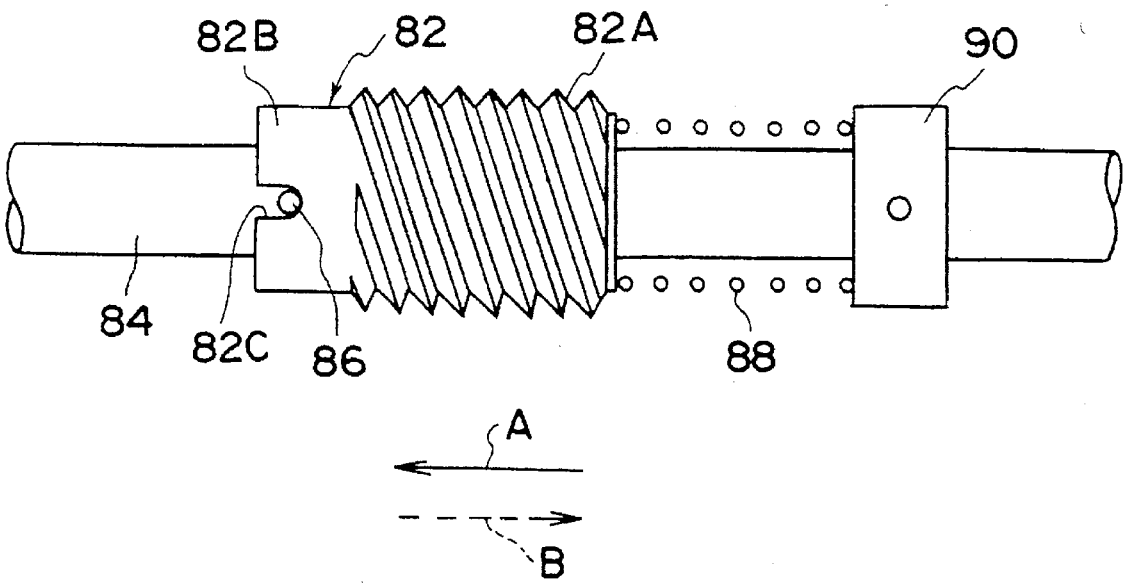
FIG. 3 is a side view which illustrates an example of an engaged state of a rotating shaft member with a movable worm gear in a drive force transmitting mechanism according to the present invention.

As shown in FIGS. 2 and 3, the movable worm gear 82 is supported by the rotating shaft 84 rotated by a drive source (not shown) such as a motor in the direction of arrow C. The rotating shaft 84 is disposed along the developing tank 22, the fixing tank 24 and the washing tank 26 and imparts the drive force to the rollers in each processing tank. At one end of the teeth 82A, a cylindrical portion 82B having a circular shaped exterior surface is monolithically formed with the teeth 82A. A groove 82C which has an opening in the direction of the axis and substantially a U-shaped cross-section, is formed at the end portion of the cylindrical portion 82B.

Further, a pin 86 (projection portion) projecting toward the radial direction is fixed on the outer periphery of the rotating shaft 84. The pin 86 is provided in pairs in the present embodiment. The pin 86 has a shape capable of being accommodated in the above-described groove 82C. The rotation of the rotating shaft 84 can be transmitted to the movable worm gear 82 via the pin 86 when the pin 86 is accommodated in the groove 82C.

One end of a compression coil spring 88 abuts against the other end of the movable worm gear 82. The other end of the compression coil spring 88 abuts against a collar 90 as an engaging member secured to the rotating shaft 84. Accordingly, the movable worm gear 82 is urged by the urging force of the compression coil spring 88 in one-direction (in the direction of arrow A in FIG. 2) of the axis of the rotating shaft 84. The pin 86 of the rotating shaft 84 maintains the state that the pin 96 is accommodated in the groove 82C by the urging force. Further, when the rotating shaft 84 is rotated in a state that the pin 86 is not accommodated in the groove 82C, the movable worm gear 82 is moved so as to accommodate the pin 86 (moved along the central axis of rotation of the rotating shaft 84) at the time when the position of the pin 86 corresponds to that of the groove 82C. The urging force of the compression coil spring 88 can suitably be selected in consideration of the torque of the rollers required for transporting the sheet film 12. To this end, in addition to the selection of the types of the compression coil spring 88, the position of the collar 90 on the rotating shaft 84 may be changed so as to change the distance between the movable worm gear 82 and the collar 90. In the event that the sheet film 12 is jammed while the sheet film 12 is being conveyed by the roller pairs 60, the rotation of the roller pairs 60 is prevented so that each gear at the downstream of the spur gear 80 meshed with the movable worm gear 82 cannot be rotated while the rotation of the rotating shaft 84 is rotated and an excessive load between the movable worm gear 82 and the spur gear 80 meshed therewith arises.

Owing to the excessive load, the thrust force, i.e., the moving force in the direction of arrow B in FIG. 2 is applied to the movable gear 82. When the thrust force becomes larger than the urging force of the compression coil spring 82, the movable worm gear 82 is axially moved in the direction of arrow B in FIG. 2, against the urging force of the compression coil spring 88. Consequently, the pin 86 is removed from the groove 82C by the axial movement of the movable worm gear 82 so that the driving force is not transmitted to the drive system in the downstream side of the movable worm gear 82. Accordingly, damage such as teeth breakage of the gears due to the excessive load imparted to each gear while the sheet film is being jammed can be avoided.

The operation of the present embodiment will be described hereinafter.

A sheet film 12 is inserted from the film insertion roller pairs 34 into the automatic processing apparatus 10 and conveyed in to the processing station 16 to immerse and process the sheet film 12 in the developing solution, the fixing solution and the washing water in sequence during the transportation of the sheet film 12. The processed sheet film 12 is conveyed to the drying station 18 to be dried and is discharged into the film discharge tray (not shown) to be stacked in order.

When a sheet film 12 is jammed in a state that the sheet film 12 is nipped by a pair of rollers 60, a force which prevents the rotation of the pair of rollers 60 arises. Accordingly, an excessive load is applied to the drive system such as the spur gear 70 attached to the roller 60, the large diameter spur gear 72 and the like. The excessive load also arises between the movable worm gear 82 and the spur gear 80.

Owing to this excessive load, the thrust force (the moving force along the rotating shaft 84 in the direction of arrow B in FIG. 2 is exerted on the movable worm gear 82. When the thrust force exceeds the urging force of the compression coil spring 88, the movable worm gear 82 moves in the direction of arrow B in FIG. 2, against the urging force of the compression coil spring 88.

The pin 86 is disengaged from the groove 82C by the movement of the movable worm gear 82. By the disengagement, the torque of the rotating shaft 84 is not transmitted to the movable worm gear 82 so that the rotating shaft 84 runs idle. Accordingly, the excessive load applied to each drive system in the downstream side of the movable worm gear 82 can be removed and damage such as breakage of the teeth can be prevented beforehand.

After the pin 86 is disengaged from the groove 82C, the thrust force of the movable worm gear 82 is not exerted so that the movable worm gear 82 tends to move again along the rotating shaft 84 in the direction of arrow A in FIG. 2 by the urging force of the compression coil spring 88. However, the movement of the movable worm gear 82 is prevented since the pin 86 contacts the edge surface of the cylindrical portion 82B. When the rotating shaft 84 rotates and the pin 86 corresponds to the groove 82C, the pin 86 is inserted into the groove 82C so that the drive force is again transmitted from the rotating shaft 84 to the movable worm gear 82. For example, in the case that the load does not affect the sheet film 12 nor the drive system in which drawbacks in conveyance of the sheet film 12 such as an instantaneous tardiness in the transportation of the sheet film 12 occur, the transmission of the drive force can automatically be recovered.

In contrast, in the case that the sheet film 12 is completely jammed and the sheet film 12 can only be removed manually by an operator, at the moment when the pin 86 is inserted into the groove 82C, the thrust force is recovered so that the pin 86 is disengaged from the groove 82C, immediately. Accordingly, the drive force is not transmitted, unless the cause of the excessive load is not eliminated, and therefore, damage of parts due to the excessive load can be prevented and extra damage of the sheet film 12 can also be prevented.

In the present embodiment, the drive force transmitting mechanism according to the present invention is applied to the drive force transmission for the conveying rollers in the automatic processing apparatus, but can be applicable to the drive force transmitting mechanisms for other mechanical devices.

Also, a plurality of first worm gears may be provided on the outer periphery of the first rotating shaft member.

Figure 4:
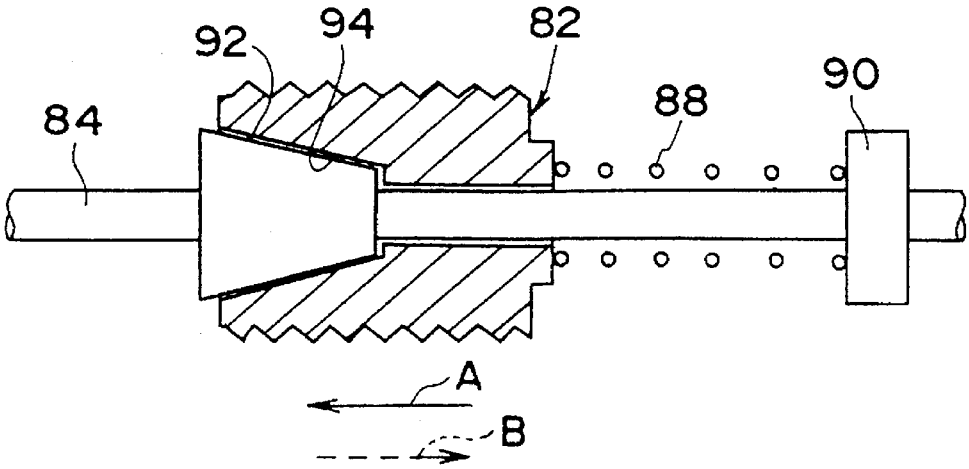
FIG. 4 is a side view which illustrates another example of an engaged state of a rotating shaft member with a movable worm gear in a drive force transmitting mechanism according to the present invention.

Further, the pin 86 and the groove 82C are used for the transmission of the drive force from the rotating shaft 84 to the movable worm gear 82. However, a pin projected from the inner surface of the movable worm gear 82, and substantially the U-shaped groove and the ring-shaped groove on the periphery of the rotating shaft 84 can also be used. Furthermore, as shown in FIG. 4, the rotating shaft 84 and the movable worm gear 82 are assembled in a tapered form and the drive force may be transmitted through the tapered surfaces 92 and 94.

As described above, the drive force transmitting mechanism according to the present invention provides such an excellent effect that an excessive load is not applied to each parts in a drive system when drawbacks which may prevent a portion to be driven from driving arise, and damage of the parts can be prevented.

What is claimed is:

1. A drive force transmitting mechanism which comprises:

a first rotating shaft member which is rotated by receiving the drive force from a drive source;

a first worm gear having a through hole through which said first rotating shaft member passes so that said first worm gear is rotated with said first rotating shaft member serving as a central axis of rotation of said first worm gear;

a rotatable mechanism which is driven by the rotation of said first worm gear, said rotatable mechanism producing a thrust force which acts on said first worm gear when rotation of said rotatable mechanism is prevented;

an urging means for urging said first worm gear so as to be movable to one direction along the central axis of rotation; and means for engaging said first worm gear with said first rotating shaft member so as to be integrally rotated due to the urging of said urging means in the one direction, and for allowing said first worm gear to move relative to said first rotating shaft member in the other direction against the urging force by said urging means, to release the engagement of said first worm gear with said first rotating shaft member, such that said first worm gear and said first rotating shaft member rotate relative to each other by the thrust force acting on said first worm gear when the rotation of said rotatable mechanism is prevented.

2. A drive force transmitting mechanism according to claim 1, wherein said engaging means comprises:

a projection portion provided on one of said first rotating shaft member and said first worm gear; and a groove, into which said projection portion is operative to be inserted, formed on the other of said first worm gear and said first rotating shaft member, wherein the drive force of said first rotating shaft member is transmitted to said first worm gear through said projection portion when said first worm gear moves relative to said first rotating shaft member in one direction along the central axis of rotation, and transmission of the drive force is released when said first worm gear moves relative to said rotating shaft member in the other direction along the central axis of rotation.

3. A drive force transmitting mechanism according to claim 1, wherein said engaging means comprises:

a taper-shaped member which is provided on the periphery of said first rotating shaft member and is tapered to be enlarged in the direction of the urging force of said urging means; and a tapered surface which is provided on the inner periphery of said first worm gear for fitting onto said taper-shaped member, wherein the drive force of said first rotating shaft member is transmitted to said first worm gear through said taper-shaped member when said first worm gear moves relative to said first rotating shaft member in one direction along the central axis of rotation, and transmission of the drive force is released when said first worm gear moves relative to said rotating shaft member in the other direction along the central axis of rotation.

4. A drive force transmitting mechanism according to claims 1, 2 or 3, wherein said rotatable mechanism includes at least one drive roller which receives the drive force via said first worm gear, for guiding and conveying a photosensitive material in a processing solution tank.

5. A drive force transmitting mechanism according to claim 4, said urging means comprises a compression coil spring, one end of which is secured to a fixing member provided on the outer periphery of said first rotating shaft member and the other end of which urges and presses said engaging means in the direction opposite to said fixing member.

6. A drive force transmitting mechanism according to claim 5, wherein a plurality of said first worm gears are provided on the outer periphery of said first rotating shaft member.

7. A drive force transmitting mechanism comprising:

a first rotating shaft member which has an axis of rotation substantially in the horizontal direction and is rotated by receiving the drive force from a drive source;

a first worm gear having a through hole through which said first rotating shaft member passes so that said first worm gear is rotated with said first rotating shaft member serving as a central axis of rotation of said first worm gear;

a first rotatable mechanism which has an axis of rotation substantially in the vertical direction and which is rotated by the rotation of said first worm gear;

a second rotatable mechanism which has an axis of rotation substantially in the horizontal direction and which is rotated by the rotation of said first rotatable mechanism, at least one of said first and second rotatable mechanisms producing a thrust force which acts on said first worm gear when the rotation of at least one of said first rotatable mechanism and said second rotatable mechanism is prevented;

an urging means for urging said first worm gear so as to be movable to one direction relative to said first rotating shaft member along the central axis of rotation; and means for engaging said first worm gear with said first rotating shaft member so as to be integrally rotated due to the urging of said urging means in the one direction, and for allowing said first worm gear to move relative to said first rotating shaft member in the other direction against the urging force by said urging means, to release the engagement of said first worm gear with said first rotating shaft member, such that said first worm gear and said first rotating shaft member rotate relative to each other by the thrust force acting on said first worm gear when the rotation of at least one of said first rotatable mechanism and said second rotatable mechanism is prevented.

8. A drive force transmitting mechanism according to claim 7, wherein said first rotatable mechanism comprises:

a first spur gear which meshes with said first worm gear in the vicinity of one end of a second rotating shaft member which is substantially vertically disposed; and a second worm gear disposed in the vicinity of the other end of said second rotating shaft member.

9. A drive force transmitting mechanism according to claim 8, wherein said engaging means comprises:

a projection portion provided on one of said first rotating shaft member and said first worm gear; and a groove, into which said projection portion is operative to be inserted, formed on the other of said first worm gear and said first rotating shaft member, wherein the drive force of said first rotating shaft member is transmitted to said first worm gear through said projection portion when said first worm gear moves relative to said first rotating shaft member in one direction along the central axis of rotation, and transmission of the drive force is released when said first worm gear moves relative to said rotating shaft member in the other direction along the central axis of rotation.

10. A drive force transmitting mechanism according to claim 8, wherein said engaging means comprises:

a taper-shaped member which is provided on the periphery of said first rotating shaft member and is tapered to be enlarged in the direction of the urging force of said urging means; and a tapered surface which is provided on the inner periphery of said first worm gear for fitting onto said taper-shaped member, wherein the drive force of said first rotating shaft member is transmitted to said first worm gear through said taper-shaped member when said first worm gear moves relative to said first rotating shaft member in one direction along the central axis of rotation, and transmission of the drive force is released when said first worm gear moves relative to said first rotating shaft member in the other direction along the central axis of rotation.

11. A drive force transmitting mechanism according to claims 9 or 10, wherein said urging means comprises a compression coil spring, one end of which is secured to a fixing member provided on the outer periphery of said first rotating shaft member and the other end of which urges and presses said engaging means in the direction opposite to said fixing member.

12. A drive force transmitting mechanism according to claim 11, wherein a plurality of said first worm gears are provided on the outer periphery of said first rotating shaft member.

13. A drive force transmitting mechanism comprising:

a first rotating shaft member which has an axis of rotation substantially in the horizontal direction and is rotated by receiving the drive force from a drive source;

a first worm gear having a through hole through which said first rotating shaft member passes so that said first worm gear is rotated with said first rotating shaft member serving as a central axis of rotation of said first worm gear;

a rotatable mechanism which has an axis of rotation substantially in the vertical direction and which is rotated by the rotation of said first worm gear;

at least one roller which has an axis of rotation substantially in the horizontal direction and which is rotated by the rotation of said rotatable mechanism and which guides and transports a photosensitive material in a processing tank, at least one of said rotatable mechanism and said roller producing a thrust force which acts on said first worm gear when the rotation of at least one of said rotatable mechanism and said roller is prevented;

an urging means for urging said first worm gear so as to be movable to one direction relative to said first rotating shaft member along the central axis of rotation; and means for engaging said first worm gear with said first rotating shaft member so as to be integrally rotated due to the urging of said urging means in the one direction, and for allowing said first worm gear to move relative to said first rotating shaft member in the other direction relative to said first rotating shaft member against the urging force by said urging means, to release the engagement of said first worm gear with said first rotating shaft member, such that said first worm gear and said first rotating shaft member rotate relative to each other by the thrust force acting on said first worm gear when the rotation of at least one of said rotatable mechanism and said roller is prevented.

14. A drive force transmitting mechanism according to claim 13, wherein said urging means comprises a compression coil spring, one end of which is secured to a fixing member provided on the outer periphery of said first rotating shaft member and the other end of which urges and presses said engaging means in the direction opposite to said fixing member.

15. A drive force transmitting mechanism according to claim 14, wherein said first rotatable mechanism comprises:

a first spur gear which meshes with said first worm gear in the vicinity of one end of a second rotating shaft member which is substantially vertically disposed; and a second worm gear disposed in the vicinity of the other end of said second rotating shaft member.

16. A drive force transmitting mechanism according to claim 15, wherein a second spur gear which meshes with said second worm gear is provided in the vicinity of one end a rotating shaft of said roller.

17. A drive force transmitting mechanism according to claim 15, wherein said engaging means comprises:

a projection portion provided on one of said first rotating shaft member and said first worm gear; and a groove, into which said projection portion is operative to be inserted, formed on the other of said first worm gear and said first rotating shaft member, wherein the drive force of said first rotating shaft member is transmitted to said first worm gear through said projection portion when said first worm gear moves relative to said first rotating shaft member in one direction along the central axis of rotation, and transmission of the drive force is released when said first worm gear moves relative to said first rotating shaft member in the other direction along the central axis of rotation.

18. A drive force transmitting mechanism according to claim 15, wherein said engaging means comprises:

a taper-shaped member which is provided on the periphery of said first rotating shaft member and is tapered to be enlarged in the direction of the urging force of said urging means; and a tapered surface which is provided on the inner periphery of said first worm gear for fitting onto said taper-shaped member, wherein the drive force of said first rotating shaft member is transmitted to said first worm gear through said taper-shaped member when said first worm gear moves relative to said first rotating shaft member in one direction along the central axis of rotation, and transmission of the drive force is released when said first worm gear moves relative to said first rotating shaft member in the other direction along the central axis of rotation.

19. A drive force transmitting mechanism according to claim 17, wherein a plurality of said first worm gears are provided on the outer periphery of said first rotating shaft member.

20. A drive force transmitting mechanism according to claim 18, wherein a plurality of said first worm gears are provided on the outer periphery of said first rotating shaft member.

* * * * *